US007690335B2

(12) United States Patent
Togawa et al.

(10) Patent No.: US 7,690,335 B2
(45) Date of Patent: Apr. 6, 2010

(54) WATER PUMP AND CONTROL METHOD FOR SAME

(75) Inventors: Kyosuke Togawa, Nishikamo-gun (JP); Takasuke Shikida, Okazaki (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 210 days.

(21) Appl. No.: 12/078,146

(22) Filed: Mar. 27, 2008

(65) Prior Publication Data

US 2008/0236517 A1 Oct. 2, 2008

(30) Foreign Application Priority Data

Mar. 29, 2007 (JP) ..... 2007-088921

(51) Int. Cl.
*F01P 5/10* (2006.01)

(52) U.S. Cl. ..... 123/41.47; 123/41.02

(58) Field of Classification Search ..... 123/41.02, 123/41.44–41.47

See application file for complete search history.

(56) References Cited

FOREIGN PATENT DOCUMENTS

| | | |
|---|---|---|
| JP | U-05-58832 | 8/1993 |
| JP | A-06-056101 | 3/1994 |
| JP | A-11-006433 | 1/1999 |
| JP | A-2005-233044 | 9/2005 |

*Primary Examiner*—Noah Kamen
(74) *Attorney, Agent, or Firm*—Oliff & Berridge, PLC

(57) ABSTRACT

A water pump is driven by a driving force generated by an internal combustion engine, and generates a larger driving force as a pressure introduced into a pressure chamber becomes higher. The pressure chamber is connected to a VSV through a first passage. A portion of an intake passage, which is located downstream of a throttle valve, is connected to the VSV through a second passage. An atmospheric pressure space is connected to the VSV through a third passage. In the VSV, the volume of wax in a temperature-sensitive case is increased to increase the ratio of the cross sectional area of an opening portion of the third passage, which is connected to the first passage, to the cross sectional area of an opening portion of the second passage, which is connected to the first passage, as the temperature of a coolant for the internal combustion engine increases.

8 Claims, 8 Drawing Sheets

WATER PUMP AND CONTROL METHOD FOR SAME

INCORPORATION BY REFERENCE

The disclosure of Japanese Patent Application No. 2007-088921 filed on Mar. 29, 2007, including the specification, drawings and abstract is incorporated herein by reference in its entirety.

BACKGROUND OF THE INVENTION

1. Field of the Invention

The invention relates to a water pump that is driven by a driving force generated by an internal combustion engine, and a control method for the same.

2. Description of the Related Art

A water pump, which circulates a coolant in a water jacket, is used for an internal combustion engine. For example, Japanese Utility Model Application Publication No. 5-58832 (JP-U-5-58832) describes a water pump in which blades fitted to a rotational shaft (rotational body) are rotated to circulate a coolant. In the water pump, a driving force generated by the internal combustion engine is transmitted from a pulley, which is rotated in synchronization with the rotation of a crankshaft of the internal combustion engine, to the rotational shaft through a fluid coupling. Thus, the blades are rotated. In the water pump, as the temperature of the coolant in the water jacket becomes higher, a degree of engagement between the rotational shaft and the fluid coupling becomes higher. Thus, as the temperature of the coolant in the water jacket becomes higher, the driving force generated by the internal combustion engine is transmitted to the rotational shaft with a higher degree of efficiency.

In the water pump, it is preferable to control a circulation amount of the coolant based on an engine speed, the temperature of the coolant, and the load of the internal combustion engine. In this regard, in the water pump, the driving force generated by the internal combustion engine is transmitted from the pulley, which is rotated in synchronization with the rotation of the crankshaft of the internal combustion engine, to the rotational shaft. Therefore, as the engine speed becomes higher, the rotational speed of the rotational shaft becomes higher, and the circulation amount of the coolant becomes larger, as described above. In the control based on the temperature of the coolant and the load of the internal combustion engine, it is preferable to increase the circulation amount of the coolant by transmitting the driving force generated by the internal combustion engine to the rotational shaft with a high degree of efficiency, when the temperature of the coolant is high, and when the load of the internal combustion engine is high, as shown by a map in FIG. 6. However, in the water pump described in the above-described Japanese Utility Model Application Publication No. 5-58832 (JP-U-5-58832), the degree of transmission efficiency, with which the driving force is transmitted to the rotational shaft, is changed based on only the temperature of the coolant. Therefore, even when the load of the internal combustion engine is high, the rotational speed of the rotational shaft is not greatly increased, and the circulation amount of the coolant cannot be appropriately controlled, if the temperature of the coolant is low. Accordingly, for example, water pumps shown in FIG. 7 and FIG. 8 are examined. In each of the water pumps shown in FIG. 7 and FIG. 8, the rotational speed can be controlled in a manner shown by the map in FIG. 6. Hereinafter, the configurations of the water pumps will be described more specifically.

As shown in FIG. 7, a water pump 130 includes a circulation system 20 and a drive system 30 that functions as a drive portion. The circulation system 20 circulates a coolant. The drive system 30 drives a rotational cylinder 21 of the circulation system 20. A partition wall 40 is provided between the circulation system 20 and the drive system 30 to prevent the coolant from flowing into the drive system 30 from the circulation system 20.

A flow passage 23, through which the coolant flows, is formed in a cylinder block 22 of the internal combustion engine. A support shaft 25 whose one end is fixed to the partition wall 40 is provided in the flow passage 23. Bearings 24*a* and 24*b* are provided at respective ends of the support shaft 25. The support shaft 25 is fitted into the rotational cylinder 21 to which the blades 26 are attached. Thus, the rotational cylinder 21 is supported by the support shaft 25 in a manner such that the rotational cylinder 21 is rotatable relative to the support shaft 25. An induction ring 27, which includes an iron core, is fitted to an outer periphery of the rotational cylinder 21 at an end portion close to the partition wall 40.

A housing 31 is provided in the drive system 30. A pulley 32 is fixed to the housing 31. The pulley 32 is operatively connected to a crankshaft (not shown) of the internal combustion engine through a belt 33. A slider 34 is provided in the housing 31. A portion of the slider 34 is connected to the housing 31 through a spline. The slider 34 is reciprocated in the housing 31 along the axial direction of the rotational cylinder 21. A magnet 35 is attached to an end of the slider 34, which is close to the circulation system 20, in a manner such that the magnet 35 surrounds the induction ring 27 fitted to the outer periphery of the rotational cylinder 21. The magnet 35 is made of, for example, neodymium.

A spring 36 provided in the housing 31 constantly presses the slider 34 toward the circulation system 20. Torque transmitted from the crankshaft to the housing 31 through the belt 33 and the pulley 32 is transmitted to the rotational cylinder 21 by a magnetic force generated between the induction ring 27 and the magnet 35. Thus, the rotational cylinder 21 is rotated. When the blades 26 attached to the rotational cylinder 21 is rotated due to the rotation of the rotational cylinder 21, the coolant in the flow passage 23 is pressurized and delivered to a water jacket (not shown) of the internal combustion engine.

The inside of the housing 31 is divided into an atmosphere chamber 31*a* and a pressure chamber 31*b* by the slider 34. A seal member 37 is provided on the outer periphery of the slider 34 to provide sealing between the slider 34 and an inner peripheral surface of the housing 31. The pressure chamber 31*b* is kept air-tight by the seal member 37. When a pressure in the pressure chamber 31*b* changes, the slider 34 is reciprocated in the housing 1, and thus, the torque transmitted from the magnet 35 to the rotational cylinder 21 through the induction ring 27 is changed. Thus, in the water pump 130, the rotational cylinder 21 constitutes a rotational body driven by the reciprocating movement of the slider 34.

In the drive system 30, a pressure pipe 41 is inserted in the pressure chamber 31*b* of the housing 31. The pressure pipe 41 is supported by a bearing 42 provided in the housing 31, and fixed to another member (not shown). The housing 31 is rotatable relative to the pressure pipe 41. A seal portion 43 is provided between the pressure pipe 41 and the inner peripheral surface of the housing 31 to prevent leakage of air from the pressure chamber 31*b*. The pressure pipe 41 is connected to an electrically-controlled vacuum switching valve (hereinafter, referred to as "VSV") 55 through a first passage 52. Further, the VSV 55 is connected to a portion of an intake passage 57, which is located downstream of a throttle valve 60, through a second passage 53. Also, the VSV 55 is connected to an atmospheric pressure space in an engine room through a third passage 54. An electronic control unit 50 controls the driving of the VSV 55 to switch the position of a valve element of the VSV 55. Thus, the pressure chamber 31*b* is selectively connected to one of the intake passage 57 and the atmospheric pressure space.

The electronic control unit 50 controls the driving of the VSV 55 in the manner described below. A vehicle is provided with, for example, an accelerator pedal sensor (not shown) that detects the amount of depression of an accelerator pedal, and other sensors that detect the load of the internal combustion engine. The cylinder block 22 is provided with a coolant temperature sensor 61 that measures the temperature of the coolant. When values detected by the sensors are input to the electronic control unit 50, the electronic control unit 50 changes the position of the valve element of the VSV 55 based on the map shown in FIG. 6.

That is, when the electronic control unit 50 determines that the temperature of the coolant is high, or determines that the temperature of the coolant is low and the load of the internal combustion engine is high, based on the values detected by, and received from the sensors, the electronic control unit 50 turns a control signal for the VSV 55 "ON" so that the pressure chamber 31*b* is connected to the atmospheric air space, and atmospheric air is introduced into the pressure chamber 31*b*. As a result, as shown in FIG. 7, there is no pressure difference between the atmosphere chamber 31*a* and the pressure chamber 31*b*, and therefore, the slider 34 is pressed by the pressing force of the spring 36, and displaced toward the circulation system 20. At this time, the magnet 35 provided in the slider 34 and the induction ring 27 provided in the rotational cylinder 21 face each other, and are close to each other. Thus, an amount of magnetic flux passing through the magnet 35 and the induction ring 27 is increased, and the rotational force transmitted from the slider 34 to the rotational cylinder 21 is relatively increased. This increases the amount of the coolant discharged and supplied into the water jacket due to the rotation of the blades 26.

When the electronic control unit 50 determines that the temperature of the coolant is low and the load of the internal combustion engine is low based on the values detected by, and received from the sensors, the electronic control unit 50 turns the control signal for the VSV 55 "OFF" so that the pressure chamber 31*b* is connected to the intake passage 57. In this situation, a pressure in the portion of the intake passage 57, which is located downstream of the throttle valve 60, is lower than the atmospheric pressure. Therefore, as shown in FIG. 8, the slider 34 is displaced toward the pressure pipe 41 against the pressing force of the spring 36, due to the pressure difference between the pressure chamber 31*b* and the atmosphere chamber 31*a*. Thus, the magnet 35 provided in the slider 34 is displaced away from the induction ring 27 provided in the rotational cylinder 21 in the axial direction of the rotational cylinder 21. As a result, the amount of magnetic flux passing through the magnet 35 and the induction ring 27 is decreased as compared to when the water pump 130 is in the state shown in FIG. 7. Accordingly, the flow rate of the coolant discharged and supplied into the water jacket is relatively decreased.

Thus, in the water pump 130, the position of the valve element of the VSV 55 is changed based on the map shown in FIG. 6 so that the coolant is appropriately circulated.

In the water pump 130, the electronic control unit 50 changes the position of the valve element of the VSV 55 by determining a point indicating the current operating state in the map shown in FIG. 6, based on the values detected by, and received from the sensors. Therefore, when the rotational speed of the rotational cylinder 21 is controlled in the water pump 130, the configuration of the control is complicated, and the load of the electronic control unit is high.

SUMMARY OF THE INVENTION

The invention provides a water pump that increases a circulation amount of a coolant for an internal combustion engine when the temperature of the coolant for the internal combustion engine is high, and when the load of the internal combustion engine is high, as compared to when the temperature of the coolant for the internal combustion engine is low and the load of the internal combustion engine is low, without using a control device with a complicated configuration, and a control method for the same.

A first aspect of the invention relates to a water pump which is driven by a driving force generated by an internal combustion engine, and which generates a larger driving force as a pressure introduced into a pressure chamber becomes higher. The water pump includes a switching valve; a first passage through which the pressure chamber is connected to the switching valve; a second passage through which a portion of an intake passage for the internal combustion engine, which is located downstream of a throttle valve, is connected to the switching valve; and a third passage through which an atmospheric pressure space is connected to the switching valve. The switching valve changes a connection between the first passage and the second passage, and a connection between the first passage and the third passage, using a material whose volume is changed based on a temperature of a coolant for the internal combustion engine, to increase a ratio of a cross sectional area of an opening portion of the third passage, which is connected to the first passage, to a cross sectional area of an opening portion of the second passage, which is connected to the first passage, as the temperature of the coolant increases.

In the above-described configuration, when the temperature of the coolant for the internal combustion engine is low, the first passage is connected to the second passage using the switching valve so that pressure chamber is connected to the intake passage. When the temperature of the coolant for the internal combustion engine is high, the first passage is connected to the third passage using the switching valve so that the pressure chamber is connected to the atmospheric pressure space. Thus, when the temperature of the coolant is high, a pressure in the pressure chamber is equal to the atmospheric pressure, and therefore, the water pump generates a relatively large driving force. When the temperature of the coolant is low, the pressure in the pressure chamber is substantially equal to a pressure in the portion of the intake passage, which is located downstream of the throttle valve. When the temperature of the coolant is low and the load of the internal combustion engine is low, the pressure in the portion of the intake passage, which is located downstream of the throttle valve, is lower than the atmospheric pressure. Therefore, the pressure in the pressure chamber is equal to this pressure that is lower than the atmospheric pressure. As a result, the water pump generates a relatively small driving force. When the temperature of the coolant is low and the load of the internal combustion engine is high, the opening degree of the throttle valve is large in the intake passage, and the pressure in the intake passage is not so low. Therefore, in this situation, the pressure in the pressure chamber is not so low, and the water pump generates a relatively large driving force. Particularly, when the throttle valve is fully-open due to the high load of the internal combustion engine, the pressure in the portion of the intake passage, which is located downstream of the throttle valve, is substantially equal to the atmospheric pressure. In this situation, the pressure in the pressure chamber is also substantially equal to the atmospheric pressure. Therefore, the water pump generates a large driving force as in the case where the pressure chamber is connected to the atmospheric pressure space.

Thus, with the above-described configuration, when the temperature of the coolant for the internal combustion engine is high, and when the load of the internal combustion is high, it is possible to increase the driving force generated by the water pump, thereby increasing the circulation amount of the coolant for the internal combustion engine as compared to when the temperature of the coolant for the internal combustion engine is low and the load of the internal combustion engine is low, without using a control device with a complicated configuration.

A second aspect of the invention relates to a water pump. The water pump includes a rotational body which includes a blade that applies a pressure to a fluid, and which circulates a coolant between an internal combustion engine and a radiator; a housing; a slider provided in the housing; a pressure chamber defined by the housing and the slider; a drive portion which transmits a driving force generated by the internal combustion engine to the rotational body with a higher degree of efficiency as a pressure in the pressure chamber becomes higher, using the slider that is reciprocated in the housing based on a change in the pressure in the pressure chamber; a pressure passage formed by joining together a first passage connected to the pressure chamber, a second passage connected to a portion of an intake passage for the internal combustion engine, which is located downstream of a throttle valve, and a third passage connected to an atmospheric pressure space; and a switching valve. The switching valve includes a valve element provided at a portion of the pressure passage, at which the first passage, the second passage, and the third passage are joined together; a temperature-sensitive portion that contains a material whose volume is changed based on a temperature of the coolant; and a displacement portion that displaces the valve element to increase a ratio of a cross sectional area of an opening portion of the third passage, which is connected to the first passage, to a cross sectional area of an opening portion of the second passage, which is connected to the first passage, as a temperature of the temperature-sensitive portion increases.

In the above-described configuration, when the temperature of the coolant for the internal combustion engine is low, the pressure chamber is connected to the intake passage using the switching valve. When the temperature of the coolant for the internal combustion engine is high, the pressure chamber is connected to the atmospheric pressure space using the switching valve. Thus, when the temperature of the coolant is high, the pressure in the pressure chamber is equal to the atmospheric pressure, and therefore, the driving force generated by the internal combustion engine is transmitted to the rotational body through the slider with a relatively high degree of efficiency. When the temperature of the coolant is low and the load of the internal combustion engine is low, the pressure in the intake passage is lower than the atmospheric pressure, and the pressure in the pressure chamber is also lower than the atmospheric pressure. Accordingly, in this situation, the driving force generated by the internal combustion engine is transmitted to the rotational body through the slider with a relatively low degree of efficiency. When the temperature of the coolant is low and the load of the internal combustion engine is high, the pressure chamber is connected to the intake passage. Because the opening degree of the throttle valve is large in the intake passage, the pressure in the intake passage is not so low, and therefore, the pressure in the pressure chamber is not so low either. As a result, the driving force generated by the internal combustion engine is transmitted to the rotational body with a relatively high degree of efficiency. Particularly, the throttle valve is fully-open due to the high load of the internal combustion engine, the pressure in the portion of the intake passage, which is located downstream of the throttle valve, is substantially equal to the atmospheric pressure. In this situation, the pressure in the pressure chamber is also substantially equal to the atmospheric pressure. Therefore, the driving force generated by the internal combustion engine is transmitted to the rotational body with the substantially same degree of efficiency as in the case where the pressure chamber is connected to the atmospheric pressure space.

Thus, with the above-described configuration, when the temperature of the coolant for the internal combustion engine is high, and when the load of the internal combustion is high, it is possible to transmit the driving force generated by the internal combustion engine to the rotational body with a high degree of efficiency, thereby increasing the circulation amount of the coolant for the internal combustion engine as compared to when the temperature of the coolant for the internal combustion engine is low and the load of the internal combustion engine is low, without using a control device with a complicated configuration.

A third aspect of the invention relates to a control method for a water pump which is driven by a driving force generated by an internal combustion engine, and which generates a larger driving force as a pressure introduced into a pressure chamber becomes higher, wherein the water pump includes a switching valve; a first passage through which the pressure chamber is connected to the switching valve; a second passage through which a portion of an intake passage for the internal combustion engine, which is located downstream of a throttle valve, is connected to the switching valve; and a third passage through which an atmospheric pressure space is connected to the switching valve, and wherein the switching valve changes a connection between the first passage and the second passage, and a connection between the first passage and the third passage. The control method includes changing the connection between the first passage and the second passage, and the connection between the first passage and the third passage to increase a ratio of a cross sectional area of an opening portion of the third passage, which is connected to the first passage, to a cross sectional area of an opening portion of the second passage, which is connected to the first passage, as a temperature of a coolant for the internal combustion engine increases, using the switching valve.

A fourth aspect of the invention relates to a control method for a water pump which is used for an internal combustion engine, and which includes a pressure chamber defined by a housing and a slider provided in the housing; a pressure passage formed by joining together a first passage connected to the pressure chamber, a second passage connected to a portion of an intake passage for the internal combustion engine, which is located downstream of a throttle valve, and a third passage connected to an atmospheric pressure space; and a valve element provided at a portion of the pressure passage, at which the first passage, the second passage, and the third passage are joined together. The control method includes displacing the valve element to increase a ratio of a cross sectional area of an opening portion of the third passage, which is connected to the first passage, to a cross sectional area of an opening portion of the second passage, which is connected to the first passage, as a temperature of a coolant that is circulated between the internal combustion engine and a radiator increases.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein:

FIG. 5A shows the state of the VSV when the temperature of the coolant for the internal combustion engine is low, and FIG. 5B shows the state of the VSV when the temperature of the coolant for the internal combustion engine is high;

DETAILED DESCRIPTION OF EMBODIMENTS

First Embodiment

Figure 7:
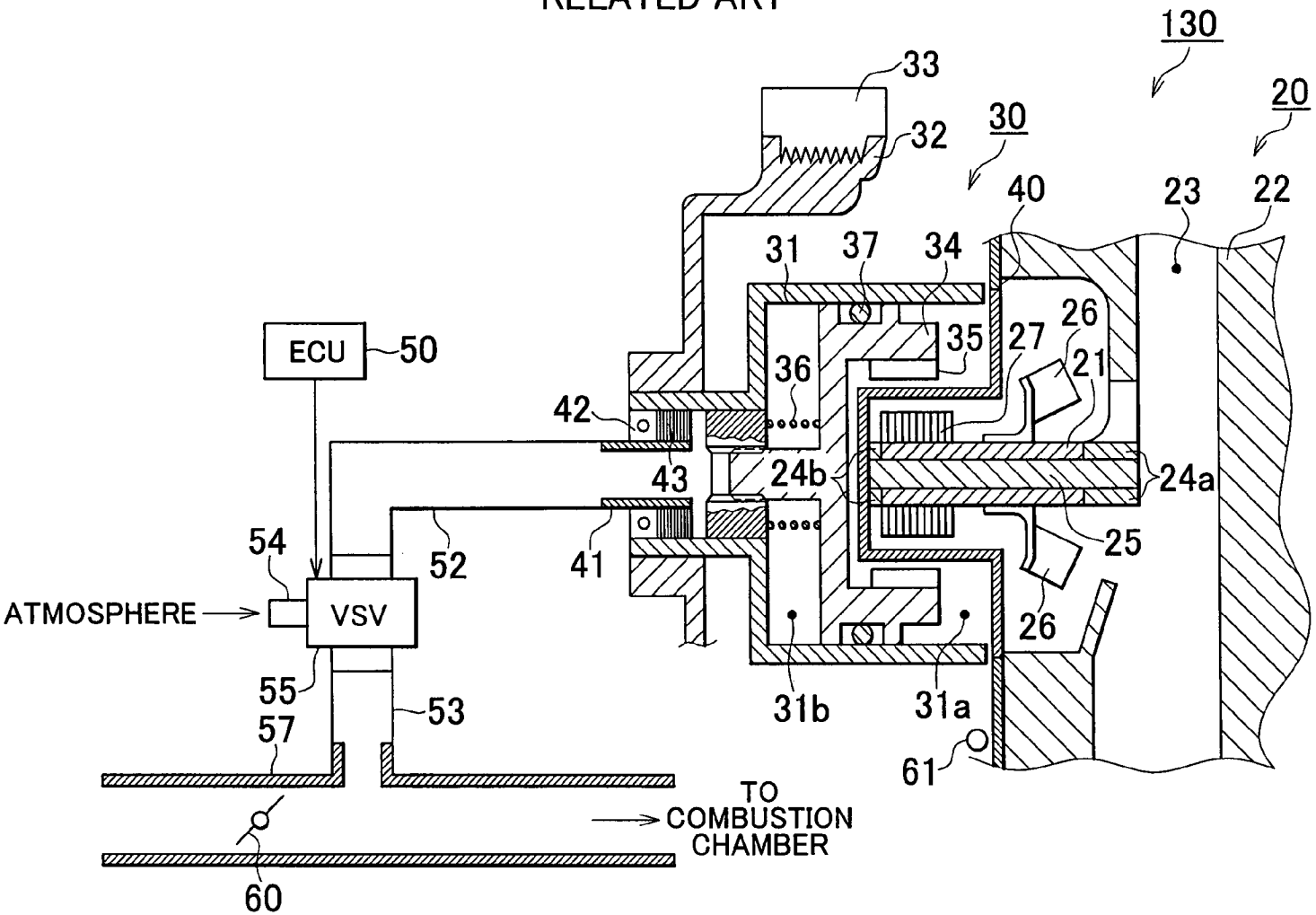
FIG. 7 RELATED ART
FIG. 7 is a schematic diagram showing the state of a water pump in related art when the flow rate of the coolant is relatively increased.
Figure 8:
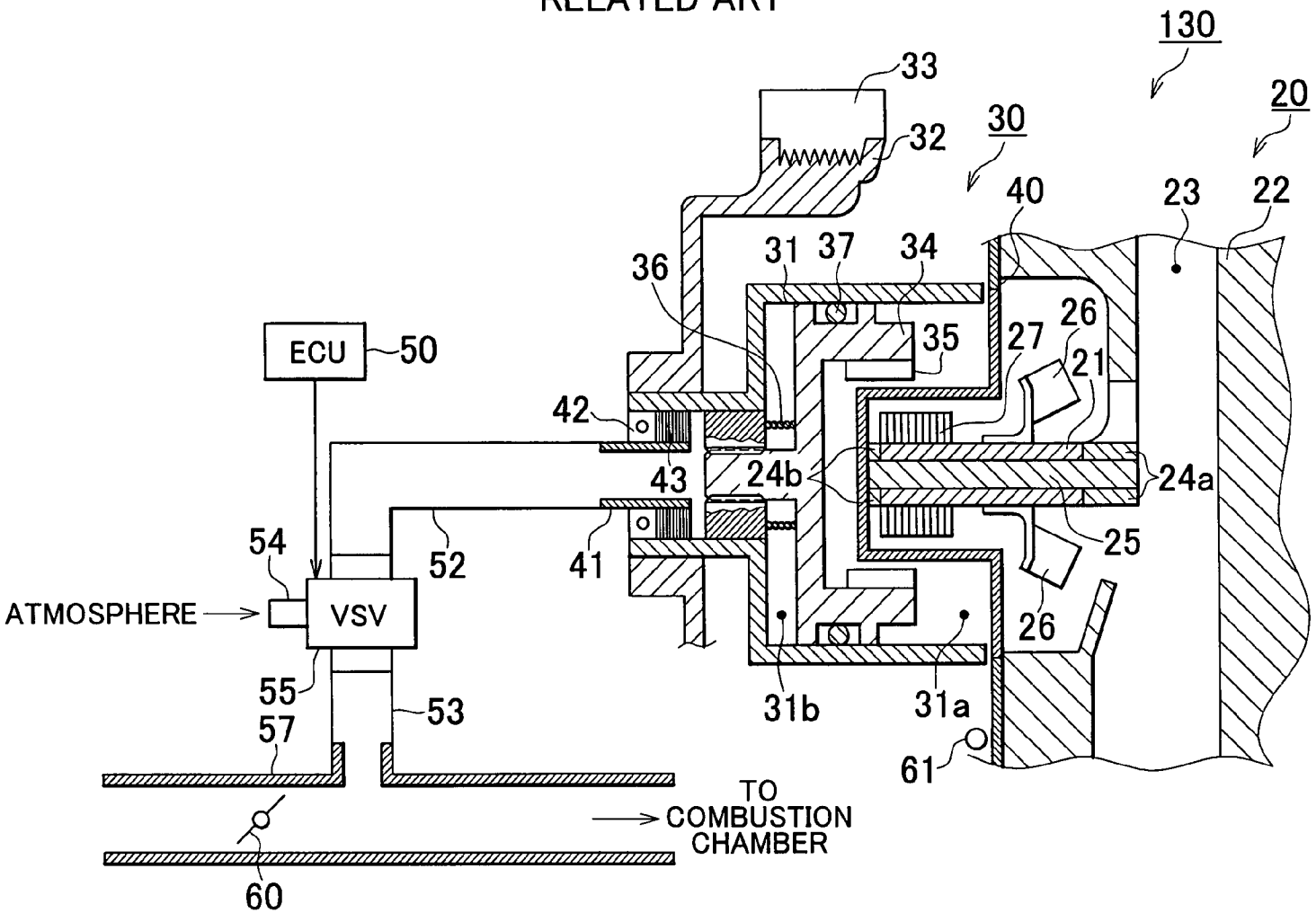
FIG. 8 RELATED ART
FIG. 8 is a schematic diagram showing the state of the water pump in the related art when the flow rate of the coolant is relatively decreased.

Hereinafter, a water pump 10 according to a first embodiment of the invention will be described with reference to FIG. 1 to FIG. 4. Each of FIG. 1 to FIG. 4 is a schematic diagram showing the water pump according to the first embodiment. In each of FIG. 1 to FIG. 4, a part of the water pump 10, such as a drive system, a circulation system, and a switching valve of the water pump 10, is shown in a cross sectional view. In each of FIG. 1 to FIG. 4, members that have the same functions as those in the water pump 130 in the related art shown in FIG. 7 and FIG. 8 are denoted by the same reference numerals, and the description thereof will be omitted.

In the water pump 10, when the blades 26 attached to the rotational cylinder 21 are rotated, a coolant, which has flown out from the outlet of the water jacket, flows through the flow passage 23. Thus, the coolant is discharged and supplied into the inlet of the water jacket. The water pump 10 circulates the coolant in the water jacket in this manner.

In the first embodiment, the outlet of the water jacket is connected to first to third coolant passages 73, 74, and 75. More specifically, the first coolant passage 73 is connected to the outlet of the water jacket and the inlet of a radiator 70. The outlet of the radiator 70 is connected to the flow passage 23 through a fourth coolant passage 76. Thus, the coolant, which has flown out from the water jacket, flows into the radiator 70 through the first coolant passage 73. After heat of the coolant is radiated, and thus, the coolant is cooled in the radiator 70, the coolant flows through the fourth coolant passage 76 and the flow passage 23, and returns into the water jacket. A thermostat 71 is provided in the fourth coolant passage 76. When the temperature of the coolant flowing out from the water jacket is equal to or higher than a predetermined temperature, the thermostat 71 allows the flow of the coolant in the fourth coolant passage 76 from the outlet of the radiator 70 to the flow passage 23. When the temperature of the coolant is lower than the predetermined temperature, the thermostat 71 interrupts the flow of the coolant in the fourth coolant passage 76 from the outlet of the radiator 70 to the flow passage 23. That is, when the temperature of the coolant is equal to or higher than the predetermined temperature, the coolant, which has flown out from the water jacket, flows through the radiator 70, and returns to the flow passage 23. When the temperature of the coolant is lower than the predetermined temperature, the flow of the coolant to the radiator 70 is blocked.

The second coolant passage 74 connects the outlet of the water jacket to a portion of the fourth coolant passage 76, which is located downstream of the thermostat 71. The second coolant passage 74 bypasses the radiator 70 and the thermostat 71. As described above, when the temperature of the coolant is lower than the predetermined temperature, the flow of the coolant into the radiator 70 is blocked. In this case, the coolant flows through the second coolant passage 74, and a portion of the fourth coolant passage 76, and then, flows into the flow passage 23.

The third coolant passage 75 connects the water jacket to the portion of the fourth coolant passage 76, which is located downstream of the thermostat 71. The coolant selectively flows through one of the first and second coolant passages 73 and 74, depending on the operation of the thermostat 71. The coolant constantly flows through the third coolant passage 75 when the internal combustion engine is operated. A through-hole 77 is formed on the wall surface of the third coolant passage 75. The through-hole 77 is used to fit a VSV 80, which functions as the switching valve, to the third coolant passage 75.

Next, the configuration of the VSV 80 will be described. The VSV 80 is formed to have a vertically long and substantially columnar shape. The VSV 80 includes a hollow valve housing 81 that has an inner space. Three openings, that is, first to third openings 82, 84, and 86 are formed in the lateral surfaces of the valve housing 81 to connect the inner space to the outside of the valve housing 81. More specifically, the third opening 86, the first opening 82, and the second opening 84 are formed in the stated order from the upper position to the lower position. In the first embodiment, the openings 82, 84, and 86 do not overlap each other in a horizontal direction. The first opening 82 of the valve housing 81 is connected to a pressure pipe 41 through a first passage 62. The second opening 84 of the valve housing 81 is connected to a portion of the intake passage 57, which is located downstream of the throttle valve 60, through a second passage 63. The third opening 86 of the valve housing 81 is connected to an atmospheric pressure space 59 in an engine room through a third passage 64. That is, the first passage 62 connected to a pressure chamber 31*b*, the second passage 63 connected to the portion of the intake passage 57, which is located downstream of the throttle valve 60, and the third passage 64 connected to the atmospheric pressure space 59 are joined together at the VSV 80 to form a pressure passage. A thick bottom portion 79 is formed to constitute a bottom wall of the valve housing 81. An attachment portion 78 having a substantially cylindrical shape is formed in the center of the lower end portion of the bottom portion 79 to protrude downward. The attachment portion 78 of the VSV 80 is inserted through the through-hole 77 so that the VSV 80 is fitted to the third coolant passage 75. Also, a through-hole 89 is formed to continuously extend through the bottom portion 79 and the attachment portion 78. A thermowax device 88 (described later) is inserted through the through-hole 89.

In the VSV 80, a valve element 87 having a substantially bottomed cylindrical shape is housed in the inner space of the valve housing 81. The valve element 87 includes a body portion 92, an upper flange 93, and a lower flange 94. The body portion 92 has a bottomed cylindrical shape. The upper flange 93 has a ring shape, and obliquely extends upward from an upper end portion of an outer peripheral surface of the body portion 92. The lower flange 94 extends in a substantially horizontal direction from a lower end portion of the outer peripheral surface of the body portion 92. The valve 87 is reciprocated upward and downward in the valve housing 81. When the valve element 87 is reciprocated, a peripheral end portion of each of the flanges 93 and 94 slides on an inner peripheral surface of the valve housing 81. A length from a lower end of an outer peripheral surface of the upper flange 93 to an upper end of an outer peripheral surface of the lower flange 94 (hereinafter, referred to as "the length between the flanges 93 and 94") is longer than a length from an upper end of the first opening 82 to a lower end of the first opening 82. When the valve element 87 is reciprocated in the valve housing 81, the first opening 82 is constantly positioned between the flanges 93 and 94. Further, the length between the flanges 93 and 94 is substantially equal to a length from an upper end (a lower end) of the third opening 86 to an upper end (a lower end) of the second opening 84.

In the valve housing 81, a spring 83 is disposed between an inner bottom surface of the bottomed cylindrical-shaped body portion 92 of the valve element 87 and an upper end of the valve housing 81. The spring 83 presses the valve element 87 downward. A thick bottom portion 96 is formed in the body portion 92 of the valve element 87 to constitute a bottom wall of the body portion 92. A rod hole 95 is formed in the bottom portion 96 in a manner such that a lower end of the rod hole 95 is open.

The thermowax device 88 includes a temperature-sensitive case 90 that functions as the temperature-sensitive portion, and a piston rod 91 that functions as the displacement portion. The temperature-sensitive case 90 contains wax. When the wax expands due to an increase in the temperature of the temperature-sensitive case 90, the piston rod 91 is pushed out from the temperature-sensitive case 90. The substantially upper half portion of the temperature-sensitive case 90 is fitted into the through-hole 89 formed in the attachment portion 78 of the valve housing 81. The substantially lower half portion of the temperature-sensitive case 90 protrudes from the attachment portion 78. Thus, the substantially lower half portion of the temperature-sensitive case 90 is immersed in the coolant flowing through the third coolant passage 75. The piston rod 91 extends through the through-hole 89 formed in the bottom portion 79 of the valve housing 81. An upper portion of the piston rod 91 is fitted into the rod hole 95 of the body portion 92. With this configuration, as the temperature of the coolant flowing through the third coolant passage 75 increases, the volume of the wax in the temperature-sensitive case 90 is increased, and the piston rod 91 is pushed out from the temperature-sensitive case 90, and thus, the piston rod 91 pushes the valve element 87 upward against the pressing force of the spring 83. Accordingly, the valve element 87 is reciprocated in the valve housing 81 according to a change in the temperature of the coolant flowing through the third coolant passage 75.

Figure 1:
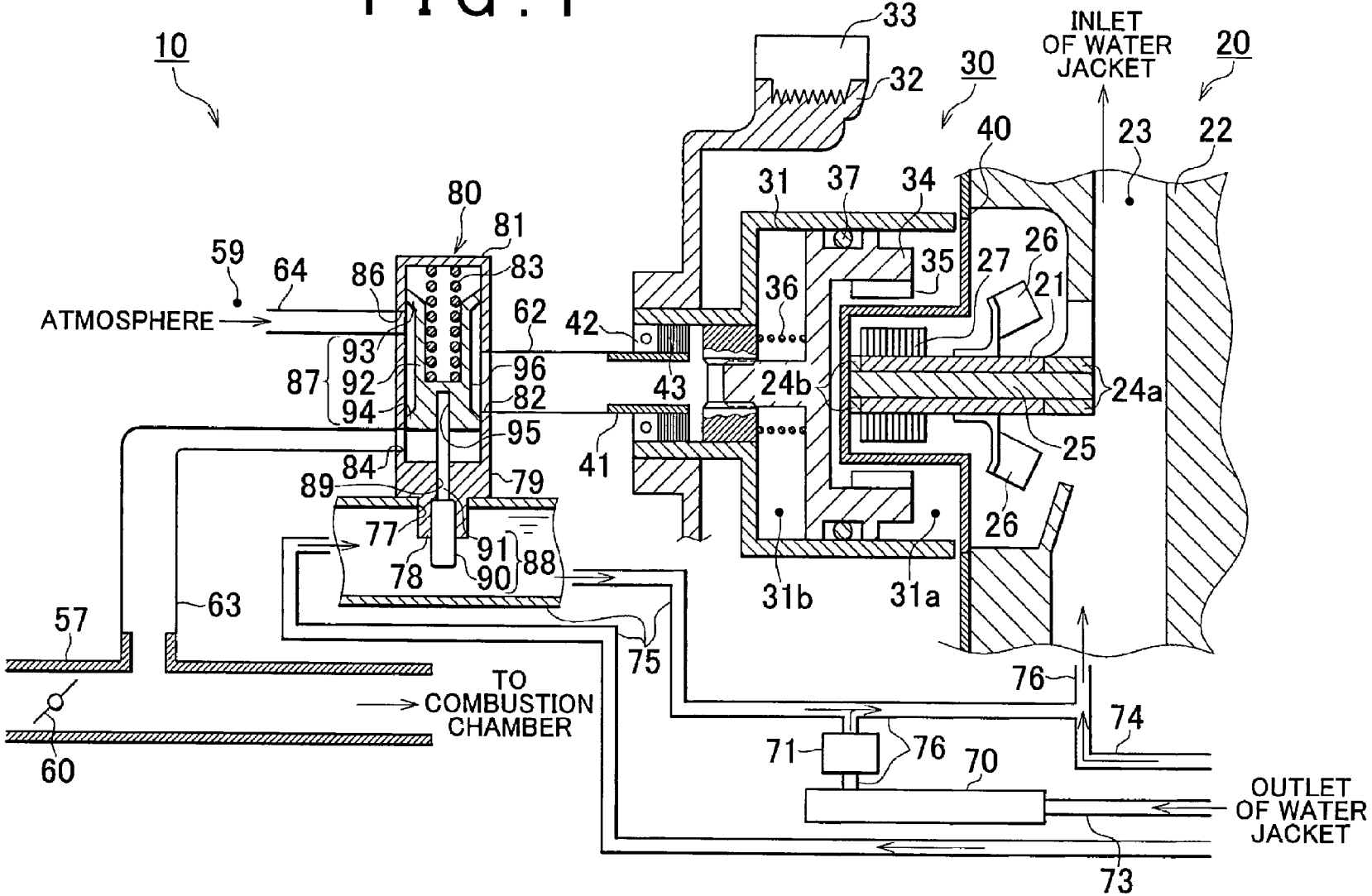
FIG. 1 is a schematic diagram showing the state of a water pump according to a first embodiment of the invention when the temperature of a coolant for an internal combustion engine is high.

Next, the displacement of the valve element 87 of the VSV 80, and a change in the circulation amount of the coolant due to the displacement of the valve element 87 in the water pump 10 will be described. When the temperature of the coolant flowing through the third coolant passage 75 is higher than a predetermined high temperature, the valve element 87 is pushed by the piston rod 91, and thus, the valve element 87 is located at an upper position inside the valve housing 81, as shown in FIG. 1. In this situation, the position of the lower flange 94 of the valve element 87 substantially matches the upper end of the second opening 84, and the position of the upper flange 93 substantially matches the upper end of the third opening 86. Thus, the first passage 62 connected to the first opening 82 is connected to the third passage 64 connected to the third opening 86. That is, in this situation, the atmospheric pressure space 59 is connected to the pressure chamber 31*b*. As a result, the pressure in the pressure chamber 31*b* is equal to the atmospheric pressure, and there is no pressure difference between the atmosphere chamber 31*a* and the pressure chamber 31*b*. Therefore, the magnet 35 provided in the slider 34 and the induction ring 27 provided in the rotational cylinder 21 face each other, and are close to each other. Thus, a rotational force transmitted from the slider 34 to the rotational cylinder 21 is relatively large. That is, the driving force generated by the internal combustion engine is transmitted to the rotational cylinder 21 through the slider 34 with a relatively high degree of efficiency, and the coolant is discharged and supplied into the water jacket at a relatively high flow rate.

Figure 2:
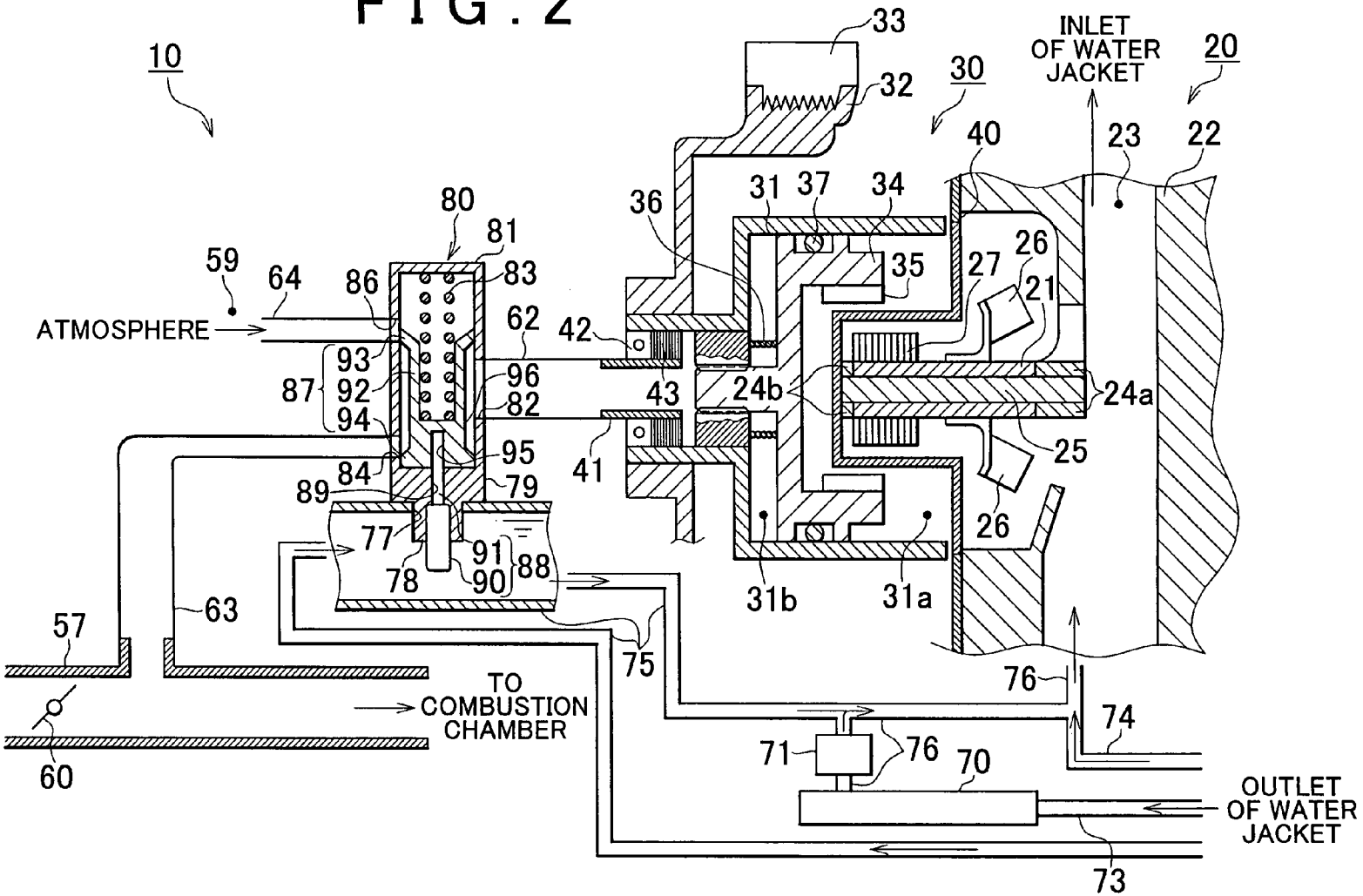
FIG. 2 is a schematic diagram showing the state of the water pump when the temperature of the coolant for the internal combustion engine is low and the load of the internal combustion engine is low.
Figure 3:
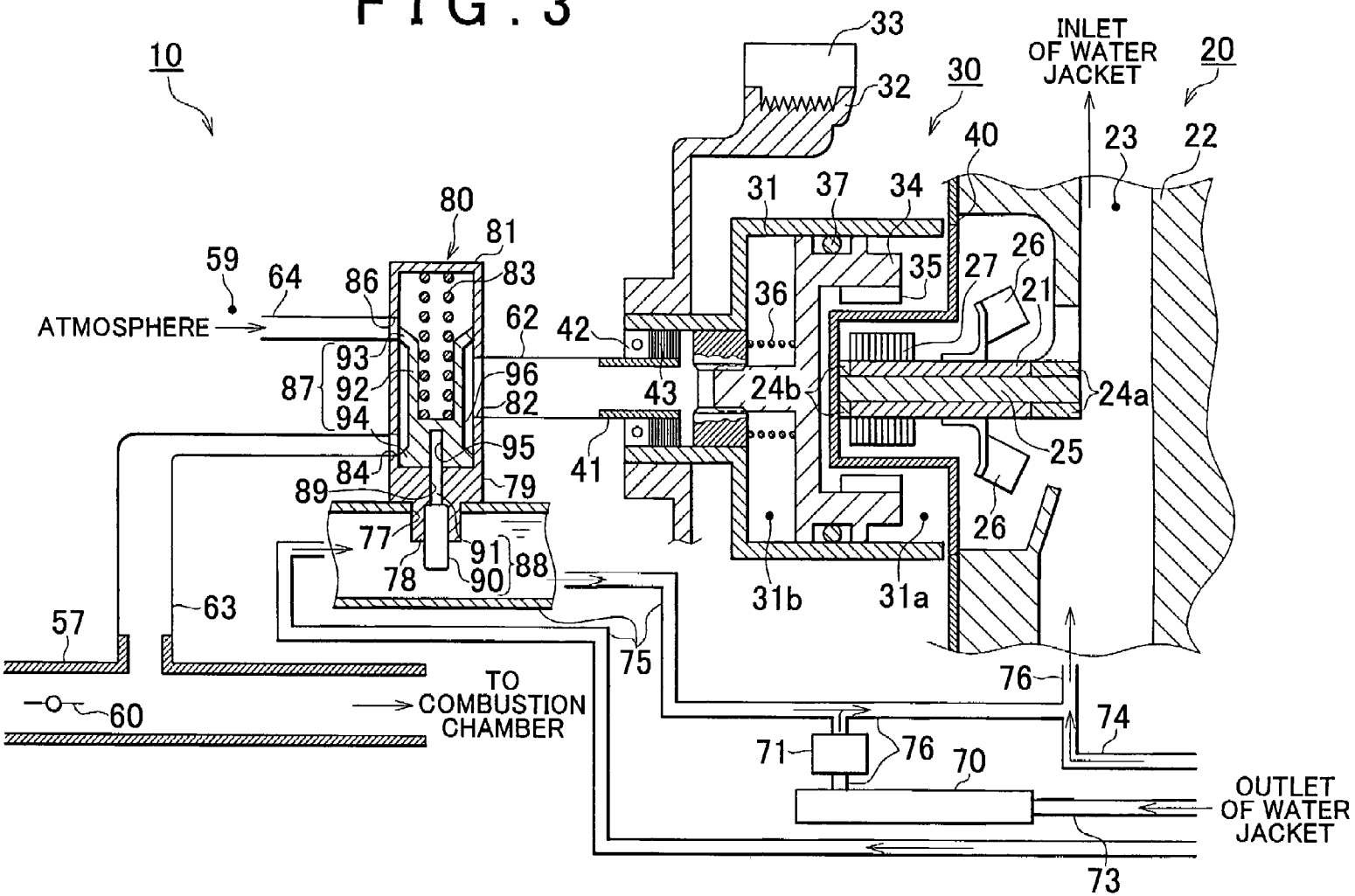
FIG. 3 is a schematic diagram showing the state of the water pump when the temperature of the coolant for the internal combustion engine is low and the load of the internal combustion engine is high.

When the temperature of the coolant flowing through the third coolant passage 75 is lower than, for example, a predetermined low temperature, the valve element 87 is not pushed upward by the piston rod 91, and thus, the valve element 87 is located at a lower position inside the valve housing 81, as shown in FIG. 2 and FIG. 3. In this situation, the position of the lower flange 94 of the valve element 87 substantially matches the lower end of the second opening 84, and the position of the upper flange 93 substantially matches the lower end of the third opening 86. Thus, the first passage 62 connected to the first opening 82 is connected to the second passage 63 connected to the second opening 84. That is, in this situation, the portion of the intake passage 57, which is located downstream of the throttle valve 60, is connected to the pressure chamber 31*b*.

The pressure in the portion of the intake passage 57, which is located downstream of the throttle valve 60, varies depending on the operating state of the internal combustion engine. That is, when the load of the internal combustion engine is low, the opening degree of the throttle valve 60 is not so large as shown in FIG. 2, and therefore, the pressure in this portion of the intake passage 57 is lower than the atmospheric pressure. When the load of the internal combustion engine is high, the opening degree of the throttle valve 60 is large as shown in FIG. 3, and therefore, the pressure in this portion of the intake passage 57 is not much lower than the atmospheric pressure. FIG. 3 shows the situation where the throttle valve 60 is fully-open. Particularly, when the throttle valve 60 is fully-open as shown in FIG. 3, the pressure in the portion of the intake passage 57, which is located downstream of the throttle valve 60, is substantially equal to the atmospheric pressure.

As a result, the pressure in the pressure chamber 31*b* is substantially equal to the atmospheric pressure.

Accordingly, when the temperature of the coolant flowing through the third coolant passage 75 is lower than the predetermined low pressure, and the load of the internal combustion engine is low, the pressure chamber 31*b* is connected to the intake passage 57 where the pressure is lower than the atmospheric pressure. Therefore, the pressure in the pressure chamber 31*b* is lower than the atmospheric pressure. Thus, as shown in FIG. 2, the slider 34 is displaced toward the pressure pipe 41 against the pressing force of the spring 36, due to the pressure difference between the pressure chamber 31*b* and the atmosphere chamber 31*a*. As a result, the rotational force transmitted from the slider 34 to the rotational cylinder 21 is relatively small. That is, the driving force generated by the internal combustion engine is transmitted to the rotational cylinder 21 with a relatively low degree of efficiency, and the coolant is discharged and supplied into the water jacket at a relatively low flow rate.

When the temperature of the coolant flowing through the third coolant passage 75 is lower than the predetermined low temperature, and the load of the internal combustion engine is high, the pressure in the intake passage 57 connected to the pressure chamber 31*b* is not much lower than the atmospheric pressure, and therefore, the pressure in the pressure chamber 31*b* is not so low. Particularly, in the situation shown in FIG. 3, the pressure in the pressure chamber 31*b* is substantially equal to the atmospheric pressure. Accordingly, as shown in FIG. 3, there is no pressure difference between the atmosphere chamber 31*a* and the pressure chamber 31*b*, and the slider 34 is displaced toward the rotational cylinder 21. As a result, the rotational force transmitted from the slider 34 to the rotational cylinder 21 is relatively large. That is, the driving force generated by the internal combustion engine is transmitted to the rotational cylinder 21 through the slider 34 with a relatively high degree of efficiency, and the coolant is discharged and supplied into the water jacket at a relatively high flow rate.

Figure 4:
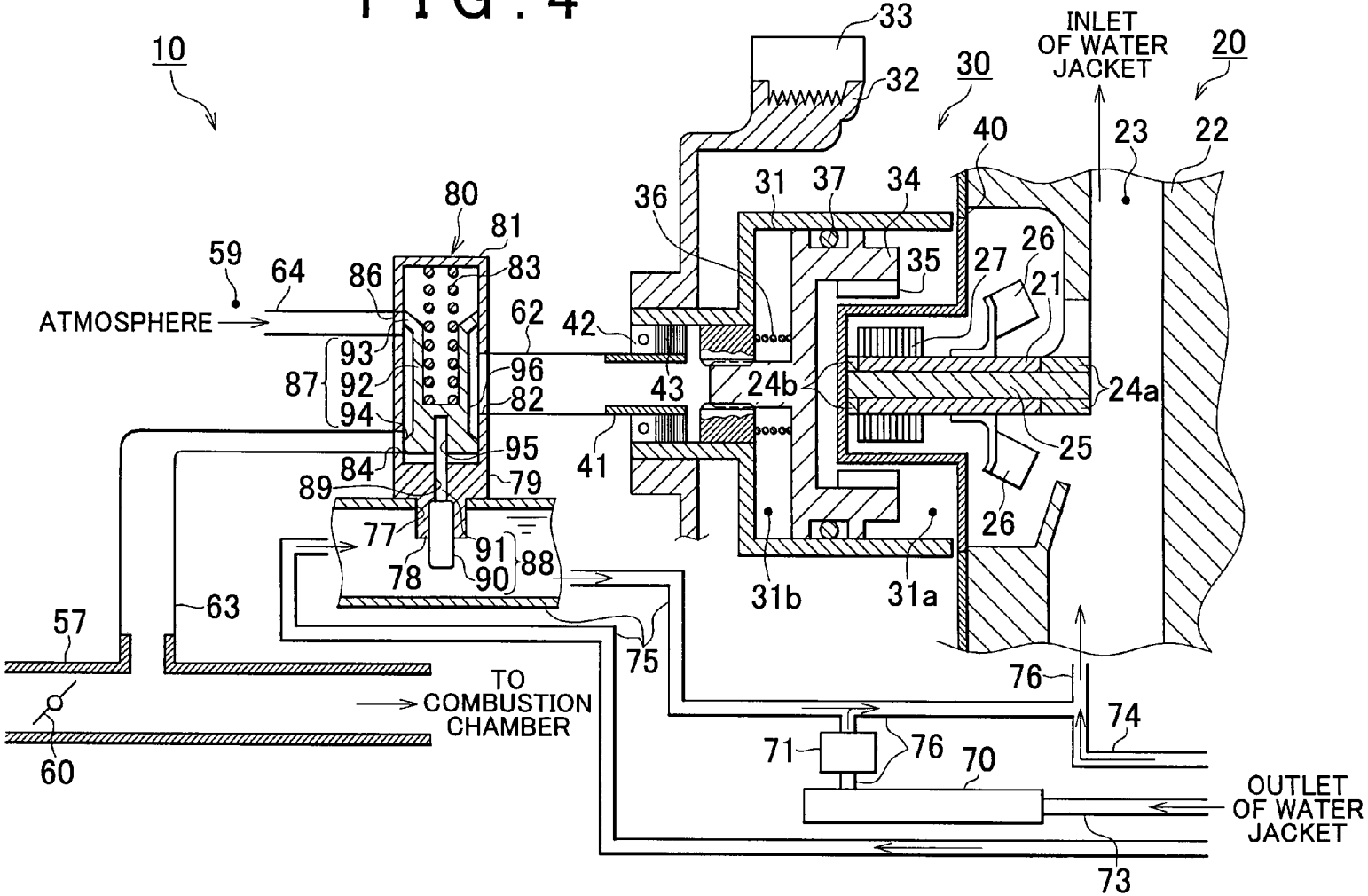
FIG. 4 is a schematic diagram showing the state of the water pump when the temperature of the coolant for the internal combustion engine is an intermediate temperature.

In the first embodiment, when the temperature of the coolant flowing through the third coolant passage 75 is between the predetermined low temperature and the predetermined high temperature, the valve element 87 is pushed to an intermediate position inside the valve housing 81, as shown in FIG. 4. In this situation, a lower portion of the third opening 86 and an upper portion of the second opening 84 are positioned between the upper flange 93 and the lower flange 94. Thus, the first passage 62 connected to the first opening 82 is connected to both of the second passage 63 connected to the second opening 84, and the third passage 64 connected to the third opening 86. Accordingly, the pressure in the pressure chamber 31*b* is between the atmospheric pressure and the pressure in the intake passage 57. Thus, for example, when the load of the internal combustion engine is low, the slider 34 is located at an intermediate position between the position of the slider 34 shown in FIG. 1 and the position of the slider 34 shown in FIG. 2. As a result, the driving force generated by the internal combustion engine is transmitted to the rotational cylinder 21 through the slider 34 with an intermediate degree of efficiency, and the circulation amount of the coolant is an intermediate amount. In this case as well, when the load of the internal combustion engine is high, the opening degree of the throttle valve 60 in the intake passage 57 is large, and therefore, the pressure in the pressure chamber 31*b* is high (for example, substantially equal to the atmospheric pressure). As a result, the driving force generated by the internal combustion engine is transmitted to the rotational cylinder 21 with a high degree of efficiency, and thus, the circulation amount of the coolant is large. In the above description, the VSV 80 is fitted to the third coolant passage 75 in a manner such that the spring 83 is located at an upper position, and the temperature-sensitive case 90 is located at a lower position. However, the manner in which the VSV 80 is fitted is not limited to this manner. For example, the VSV 80 may be fitted in a manner such that the axis of the VSV 80 is horizontal.

As described in detail, the water pump 10 according to the first embodiment has the following advantageous effects. (1) In the water pump 10 according to the first embodiment, the valve element 87 of the VSV 80 is displaced from the position at which the valve element 87 allows the pressure chamber 31*b* to be connected to the intake passage 57, to the position at which the valve element 87 allows the pressure chamber 31*b* to be connected to the atmospheric pressure space 59, as the temperature of the coolant flowing through the third coolant passage 75 increases. In other words, in the water pump 10 according to the first embodiment, the valve element 87 of the VSV 80 is displaced to increase the ratio of the cross sectional area of the opening portion of the third passage 64, which is connected to the first passage 62, to the cross sectional area of the opening portion of the second passage 63, which is connected to the first passage 62, as the temperature of the coolant flowing through the third coolant passage 75 increases. Thus, when the temperature of the coolant is high, the pressure in the pressure chamber 31*b* is substantially equal to the atmospheric pressure. Therefore, the slider 34 is displaced toward the rotational cylinder 21, and the driving force generated by the internal combustion engine is transmitted to the rotational cylinder 21 with a high degree of efficiency. When the temperature of the coolant is low and the load of the internal combustion engine is high, the pressure chamber 31*b* is connected to the intake passage 57. Because the pressure in the intake passage 57 is not much lower than the atmospheric pressure, the pressure in the pressure chamber 31*b* is not much lower than the atmospheric pressure, and therefore, the driving force generated by the internal combustion engine is transmitted to the rotational cylinder 21 with a relatively high degree of efficiency. When the temperature of the coolant is low and the load of the internal combustion engine is low, the pressure chamber 31*b* is connected to the intake passage 57 where the pressure is lower than the atmospheric pressure. As a result, the pressure in the pressure chamber 31*b* is lower than the atmospheric pressure, and therefore, the slider 34 is displaced away from the rotational cylinder 21. Thus, the driving force generated by the internal combustion engine is transmitted to the rotational cylinder 21 with a relatively low degree of efficiency.

Thus, when the temperature of the coolant for the internal combustion engine is high, and when the load of the internal combustion engine is high, it is possible to efficiently transmit the driving force generated by the internal combustion engine to the rotational cylinder 21, thereby increasing the circulation amount of the coolant as compared to when the temperature of the coolant for the internal combustion engine is low and the load of the internal combustion engine is low, without using a control device with a complicated configuration.

(2) In the water pump 10 according to the first embodiment, when the temperature of the coolant for the internal combustion engine is between the predetermined low temperature and the predetermined high temperature, the pressure chamber 31*b* is connected to both of the atmospheric pressure space 59 and the intake passage 57, using the VSV 80. Thus, when the temperature of the coolant for the internal combustion engine is an intermediate temperature, it is possible to transmit the driving force generated by the internal combustion engine to the rotational cylinder 21 with an intermediate degree of efficiency. Also, when the temperature of the coolant is an intermediate temperature, and the load of the internal combustion engine is high, the pressure in the intake passage 57 is not much lower than the atmospheric pressure, and therefore, it is possible to transmit the driving force generated by the internal combustion engine to the rotational cylinder 21 with a high degree of efficiency.

Second Embodiment

In a second embodiment, a VSV 110, which functions as the switching valve, has a configuration different from that of the VSV 80 in the first embodiment. As shown in FIG. 5, the VSV 110 includes a plate-shaped valve element 111 that pivots in a passage.

In the second embodiment, a main passage 104 includes a first passage 101, and a third passage 103 that is continuous with the first passage 101. The first passage 101 is connected to the pressure chamber. The third passage 103 is connected to the atmospheric pressure space. A second passage 102 is connected to the main passage 104 in a manner such that the second passage 102 is substantially perpendicular to the main passage 104. Thus, a pressure passage is formed by joining together the three passages 101, 102, and 103. The VSV 110 in the second embodiment includes a pivot shaft 113, and the plate-shaped valve element 111. The pivot shaft 113 is supported through a bracket 112 fitted to the third passage 103 at a position near a connection portion at which the second passage 102 is connected to the third passage 103. The plate-shaped valve element 111 is pivotably supported by the pivot shaft 113. A stopper 114 is provided in the first passage 101 at a position near a connection portion at which the second passage 102 is connected to the first passage 101. When the valve element 111 pivots around the pivot shaft 113, and closes the second passage 102 as shown in FIG. 5B, the valve element 111 contacts the stopper 114.

In the second embodiment, the valve element 111 is driven in a manner described below. That is, a drive portion 115, which drives the valve element 111, is fitted to an outer peripheral surface of the main passage 104 so that the drive portion 115 faces the connection portion at which the second passage 102 is connected to the main passage 104. The drive portion 115 includes a housing 120, a thermowax device 126, and a spring 121. The housing 120 includes a bottom portion that is slightly thick. The bottom portion of the housing 120 is inserted through the through-hole 77 of the third coolant passage 75, and thus, the housing 120 is fitted to the third coolant passage 75. An upper half portion of a temperature-sensitive case 125 of the thermowax device 126 is inserted into the bottom portion of the housing 120. A lower half portion of the temperature-sensitive case 125 protrudes from the bottom portion of the housing 120. Thus, the lower half portion of the temperature-sensitive case 125 is immersed in the coolant flowing through the third coolant passage 75. Also, a piston rod 122, which extends from the temperature-sensitive case 125, includes a rod body 123, and a plate-shaped pressing portion 124 fitted to a lower portion of the rod body 123. The rod body 123 extends through the housing 120 and a side wall of the main passage 104. An end portion of the rod body 123 is connected to the valve element 111. In the housing 120, a spring 121, which is wound around the rod body 123, is disposed between an upper end of an inner space of the housing 120 and an upper surface of the pressing portion 124. The spring 121 presses the pressing portion 124 downward.

Figure 5A:
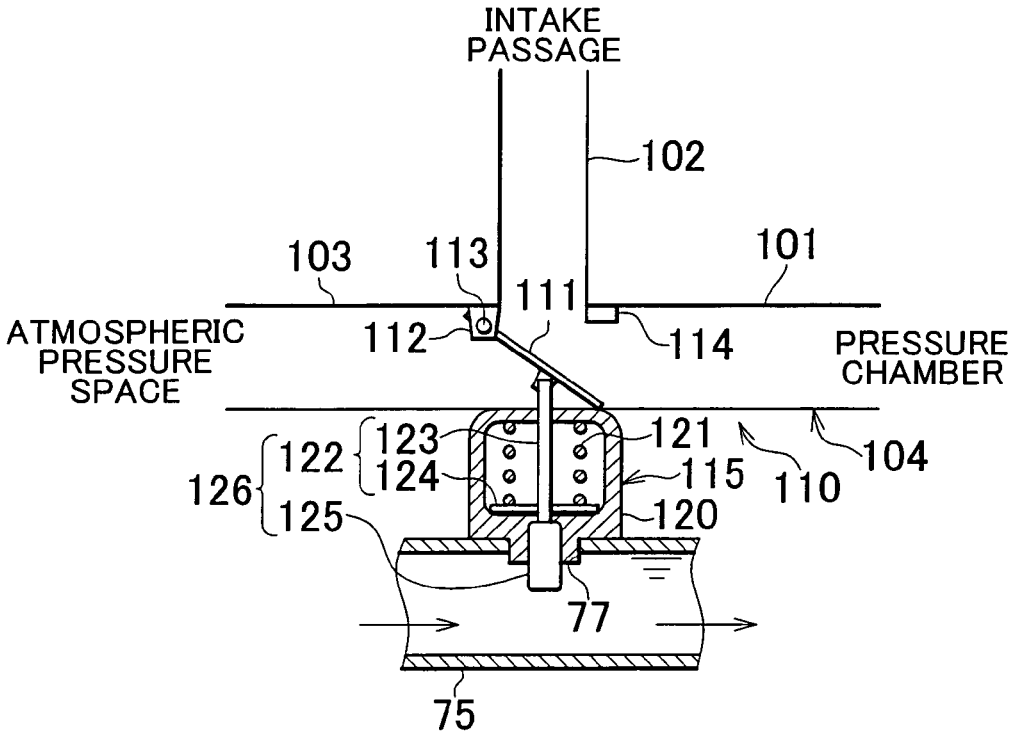
FIGS. 5A and 5B are schematic diagrams showing a VSV of a water pump according to a second embodiment of the invention.
Figure 5B:
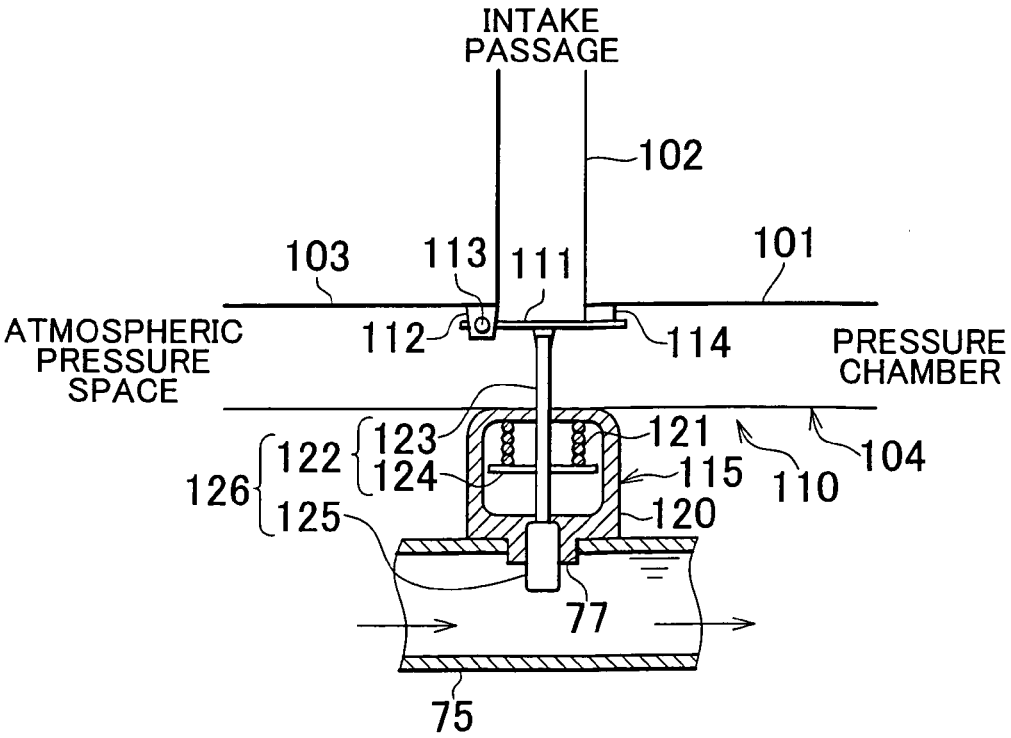
Figure 6:
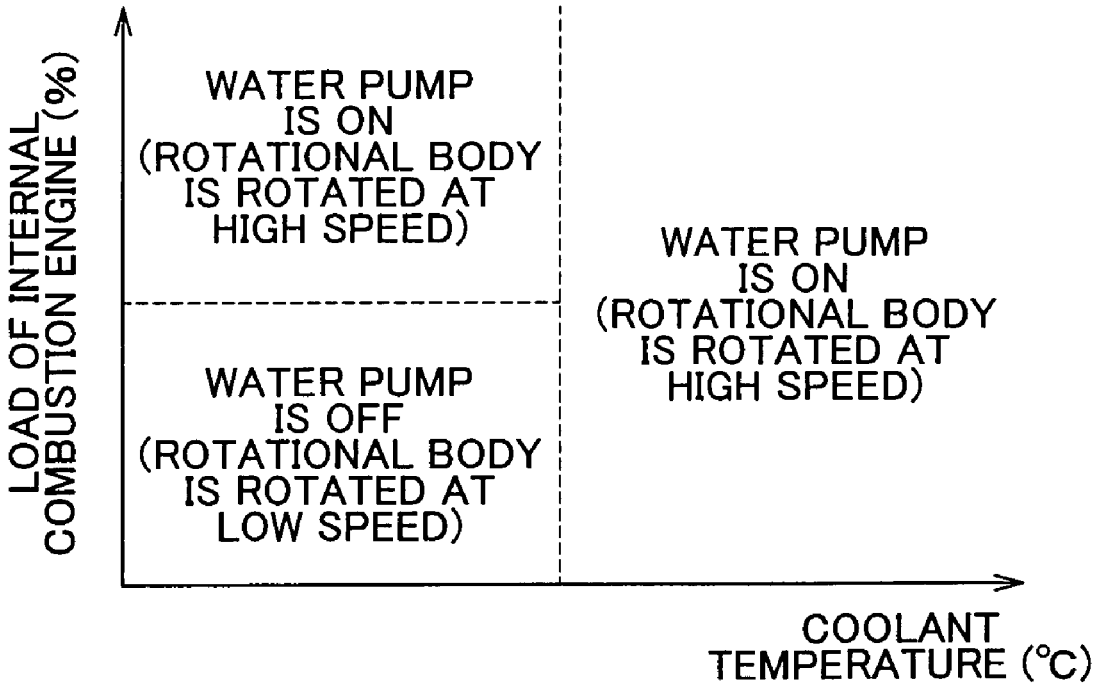
FIG. 6 RELATED ART
FIG. 6 is a graph showing a manner in which a driving force generated by the water pump is controlled based on the temperature of the coolant for the internal combustion engine and the load of the internal combustion engine.

With this configuration, when the temperature of the coolant flowing through the third coolant passage 75 is low, the second passage 102 is connected to the first passage 101 using the valve element 111 as shown in FIG. 5A. When the temperature of the coolant flowing through the third coolant passage 75 is high, the volume of the wax in the temperature-sensitive case 125 is increased, and therefore, the rod body 123 of the piston rod 122 is pushed out from the temperature-sensitive case 125 as shown in FIG. 5B. At this time, the pressing portion 124 is also displaced upward along with the rod body 123. Accordingly, the spring 121 is compressed. Thus, the valve element 111 pivots around the pivot shaft 113 due to the upward displacement of the rod body 123, and the valve element 111 closes the second passage 102 to connect the first passage 101 to the third passage 103 as shown in FIG. 5B. Also, although not shown in the drawings, when the temperature of the coolant flowing through the third coolant passage 75 is an intermediate temperature, the valve element 111 is located at an intermediate position between the position of the valve element 111 shown in FIG. 5A and the position of the valve element 111 shown in FIG. 5B. When the valve element 111 is located at the intermediate position, the first passage 101 is connected to both of the second passage 102 and the third passage 103. Accordingly, in the second embodiment as well, it is possible to obtain the same advantageous effects as those described in the sections (1) and (2) in the first embodiment. The other portions of the configuration and the effects in the second embodiment, which have not been described, are the same as those in the first embodiment.

Other Embodiments

Each of the above-described embodiments may be modified in manners described below. In each of the above-described embodiments, the VSV, which functions as the switching valve, includes the temperature-sensitive case which functions as the temperature-sensitive portion, and which contains the wax. However, for example, the temperature-sensitive portion may contain a material other than the wax. Alternatively, the temperature-sensitive portion may include a diaphragm, and the volume of the temperature-sensitive portion may be changed.

In each of the above-described embodiments, the third coolant passage 75 is provided so that the VSV is fitted to the third coolant passage 75. However, the third coolant passage 75 may not be provided, and the VSV may be provided at other portions at which the temperature of the coolant in the water jacket can be measured. More specifically, for example, although not shown in the drawings, in the case where the outlet of the water jacket is connected to the first coolant passage 73 and the second coolant passage 74 through a main coolant passage, the VSV may be provided in the main coolant passage, because the coolant, which has flown out from the water jacket, constantly flows through the main coolant passage. Also, for example, the VSV may be fitted to a cylinder block in a manner such that the temperature-sensitive portion such as the temperature-sensitive case is directly immersed in the water jacket. Further, for example, the VSV may be simply fitted to a lateral surface of the cylinder block in a manner such that the temperature-sensitive portion is not immersed in the coolant, and the temperature of the coolant is indirectly transmitted to the temperature-sensitive portion.

The configuration of the water pump 10 is not limited to the configuration in each of the above-described embodiments. For example, although the magnet 35 is provided in the slider 34, and the induction ring 27 is provided in the rotational cylinder 21, the magnet 35 may be provided in the rotational cylinder 21, and the induction ring 27 may be provided in the slider 34. That is, any configuration may be employed as long as a magnetic force is generated between the slider 34 and the rotational cylinder 21. The torque may be transmitted to the rotational cylinder 21 by changing the degree of engagement between the slider and the rotational cylinder using, for example, a friction clutch, instead of transmitting the torque to the rotational cylinder 21 using the magnetic force. In summary, any water pump may be employed as long as the water pump is driven by the driving force generated by the internal combustion engine, and the water pump generates a larger driving force as the pressure introduced into the pressure chamber becomes higher.

While the invention has been described with reference to example embodiments thereof, it is to be understood that the invention is not limited to the described embodiments or constructions. On the other hand, the invention is intended to cover various modifications and equivalent arrangements. In addition, while the various elements of the disclosed invention are shown in various example combinations and configurations, other combinations and configurations, including more, less or only a single element, are also within the scope of the appended claims.

What is claimed is:

1. A water pump which is driven by a driving force generated by an internal combustion engine, and which generates a larger driving force as a pressure introduced into a pressure chamber becomes higher, comprising:

a first passage connected to the pressure chamber;

a second passage connected to a portion of an intake passage for the internal combustion engine, which is located downstream of a throttle valve;

a third passage connected to an atmospheric pressure space; and a switching valve connected to the first passage, the second passage, and the third passage, wherein the switching valve changes a connection between the first passage and the second passage, and a connection between the first passage and the third passage, using a material whose volume is changed based on a temperature of a coolant for the internal combustion engine, to increase a ratio of a cross sectional area of an opening portion of the third passage, which is connected to the first passage, to a cross sectional area of an opening portion of the second passage, which is connected to the first passage, as the temperature of the coolant increases.

2. The water pump according to claim 1, wherein when the temperature of the coolant for the internal combustion engine is in a predetermined temperature range, the switching valve keeps the first passage connected to both of the second passage and the third passage.

3. The water pump according to claim 1, wherein the material whose volume is changed based on the temperature of the coolant for the internal combustion engine is wax.

4. A water pump comprising:

a rotational body which includes a blade that applies a pressure to a fluid, and which circulates a coolant between an internal combustion engine and a radiator;

a housing;

a slider provided in the housing;

a pressure chamber defined by the housing and the slider;

a drive portion which transmits a driving force generated by the internal combustion engine to the rotational body with a higher degree of efficiency as a pressure in the pressure chamber becomes higher, using the slider that is reciprocated in the housing based on a change in the pressure in the pressure chamber;

a pressure passage formed by joining together a first passage connected to the pressure chamber, a second passage connected to a portion of an intake passage for the internal combustion engine, which is located downstream of a throttle valve, and a third passage connected to an atmospheric pressure space; and a switching valve that includes:

a valve element provided at a portion of the pressure passage, at which the first passage, the second passage, and the third passage are joined together;

a temperature-sensitive portion that contains a material whose volume is changed based on a temperature of the coolant; and a displacement portion that displaces the valve element to increase a ratio of a cross sectional area of an opening portion of the third passage, which is connected to the first passage, to a cross sectional area of an opening portion of the second passage, which is connected to the first passage, as a temperature of the temperature-sensitive portion increases.

5. The water pump according to claim 4, wherein when the temperature of the coolant for the internal combustion engine is in a predetermined temperature range, the switching valve keeps the first passage connected to both of the second passage and the third passage.

6. The water pump according to claim 4, wherein the material whose volume is changed based on the temperature of the coolant for the internal combustion engine is wax.

7. A control method for a water pump which is driven by a driving force generated by an internal combustion engine, and which generates a larger driving force as a pressure introduced into a pressure chamber becomes higher, wherein the water pump includes a switching valve; a first passage through which the pressure chamber is connected to the switching valve; a second passage through which a portion of an intake passage for the internal combustion engine, which is located downstream of a throttle valve, is connected to the switching valve; and a third passage through which an atmospheric pressure space is connected to the switching valve, and wherein the switching valve changes a connection between the first passage and the second passage, and a connection between the first passage and the third passage, the control method comprising:

changing the connection between the first passage and the second passage, and the connection between the first passage and the third passage to increase a ratio of a cross sectional area of an opening portion of the third passage, which is connected to the first passage, to a cross sectional area of an opening portion of the second passage, which is connected to the first passage, as a temperature of a coolant for the internal combustion engine increases, using the switching valve.

8. A control method for a water pump which is used for an internal combustion engine, and which includes a pressure chamber defined by a housing and a slider provided in the housing; a pressure passage formed by joining together a first passage connected to the pressure chamber, a second passage connected to a portion of an intake passage for the internal combustion engine, which is located downstream of a throttle valve, and a third passage connected to an atmospheric pressure space; and a valve element provided at a portion of the pressure passage, at which the first passage, the second passage, and the third passage are joined together, the control method comprising:

displacing the valve element to increase a ratio of a cross sectional area of an opening portion of the third passage, which is connected to the first passage, to a cross sectional area of an opening portion of the second passage, which is connected to the first passage, as a temperature of a coolant that is circulated between the internal combustion engine and a radiator increases.

* * * * *